US007926910B2

(12) United States Patent
Cha et al.

(10) Patent No.: US 7,926,910 B2
(45) Date of Patent: Apr. 19, 2011

(54) NOZZLE PLATE FOR INKJET HEAD AND METHOD OF MANUFACTURING THE NOZZLE PLATE

(75) Inventors: Tae-woon Cha, Yongin-si (KR); Young-nam Kwon, Yongin-si (KR); Jae-chang Lee, Yongin-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 973 days.

(21) Appl. No.: 11/764,844

(22) Filed: Jun. 19, 2007

(65) Prior Publication Data

US 2008/0007594 A1 Jan. 10, 2008

(30) Foreign Application Priority Data

Jul. 5, 2006 (KR) ..... 10-2006-0062981

(51) Int. Cl.
*B41J 2/135* (2006.01)

(52) U.S. Cl. ..... 347/45; 347/47

(58) Field of Classification Search ..... 347/29, 347/45–47, 64, 67, 71, 83
See application file for complete search history.

(56) References Cited

U.S. PATENT DOCUMENTS

| | | | | |
|---|---|---|---|---|
| 6,290,337 | B1 | 9/2001 | Radke | |
| 7,267,426 | B2 * | 9/2007 | Miyajima et al. | 347/45 |
| 7,434,913 | B2 * | 10/2008 | Suzuki et al. | 347/45 |
| 7,441,871 | B2 * | 10/2008 | Nishijima | 347/47 |

FOREIGN PATENT DOCUMENTS

| | | |
|---|---|---|
| JP | 2002-187281 | 7/2002 |
| JP | 2002-254658 | 9/2002 |

* cited by examiner

*Primary Examiner* — Thinh H Nguyen
(74) *Attorney, Agent, or Firm* — Stanzione & Kim, LLP

(57) ABSTRACT

A nozzle plate for an inkjet head and a method of manufacturing the nozzle plate includes a silicon substrate having a nozzle, a thermally oxidized silicon layer formed on an outer surface of the silicon substrate and an inner wall of the nozzle, an adhesion layer deposited on the thermally oxidized silicon layer formed on the outer surface of the silicon substrate and formed of silicon oxide, and an ink-repellent coating layer deposited on the adhesion layer.

18 Claims, 7 Drawing Sheets

NOZZLE PLATE FOR INKJET HEAD AND METHOD OF MANUFACTURING THE NOZZLE PLATE

CROSS-REFERENCE TO RELATED APPLICATIONS

This application claims the benefit of Korean Patent Application No. 10-2006-0062981, filed on Jul. 5, 2006, in the Korean Intellectual Property Office, the disclosure of which is incorporated herein in its entirety by reference.

BACKGROUND OF THE INVENTION

1. Field of the Invention

The present general inventive concept relates to a nozzle plate for an inkjet head, and more particularly, to a nozzle plate for an inkjet head, which includes an ink-repellent coating layer having high durability, and a method of manufacturing the same.

2. Description of the Related Art

An inkjet head is an apparatus that ejects very small droplets of printing ink on a printing medium in a desired position to print an image in a predetermined color. Inkjet heads may be largely classified into thermal-drive inkjet heads and piezoelectric inkjet heads according to link election mechanism. The thermal-inkjet head produces bubbles using a thermal source and ejects ink due to the expansive force of the bubbles. The piezoelectric inkjet head applies pressure generated by deforming a piezoelectric material to ink and ejects the ink due to the generated pressure.

FIG. 1 is a cross-sectional view of a conventional piezoelectric inkjet head.

Referring to FIG. 1, a manifold 11, a plurality of restrictors 12, and a plurality of pressure chambers 13 are formed in a flow path plate 10 and constitute an ink flow path. A vibrating plate 20 is adhered to a top surface of the flow path plate 10. The vibrating plate 20 is deformed due to the drive of a piezoelectric actuator 40. A nozzle plate 30 having a plurality of nozzles 31 is adhered to a bottom surface of the flow path plate 10. Meanwhile, the flow path plate 10 may be integrally formed with the vibrating plate 20. Also, the flow path plate 10 may be integrally formed with the nozzle plate 30.

The manifold 11 is a path through which ink is supplied from an ink storage (not shown) to the respective pressure chambers 13. The restrictors 12 are paths through which ink is supplied from the manifold 11 to the respective pressure chambers 13. The pressure chambers 13 are arranged on one side or both sides of the manifold 11 and are filled with ink to be ejected. The nozzles 31 are formed through the nozzle plate 30 to be connected to the pressure chambers 13, respectively. The vibrating plate 20 is adhered to the top surface of the flow path plate 10 to cover the pressure chamber 13. The vibrating plate 20 is deformed due to the drive of the piezoelectric actuator 40 and provides a pressure variation required for ejecting ink to the respective pressure chambers 13. The piezoelectric actuator 40 includes a lower electrode 41, a piezoelectric layer 42, and an upper electrode 43 that are sequentially stacked on the vibrating plate 20. The lower electrode 41 is disposed on the entire top surface of the vibrating plate 20 and functions as a common electrode. The piezoelectric layer 42 is disposed on the lower electrode 42 over the respective pressure chambers 13. The upper electrode 43 is disposed on the piezoelectric layer 42 and functions as a drive electrode for applying a voltage to the piezoelectric layer 42.

In the inkjet head having the above-described construction, the surface treatment of the nozzle plate 30 directly affects the ejection performance of the inkjet head, for example, the straightness and ejection velocity of droplets of ink ejected via the nozzles 31. That is, in order to improve the ejection performance of the inkjet head, an inner wall of the nozzle 31 must be ink-philic, while the surface of the nozzle plate 30 outside the nozzle 31 must be ink-repellent. Specifically, when the inner wall of the nozzle 31 is ink-philic, the inner wall of the nozzle 31 makes a small contact angle with ink, so that the capillary force of the nozzle 31 increases. Thus, a time taken to refill ink can be shortened so that the ejection frequency of the nozzle 31 can be increased. Also, when the surface of the nozzle plate 20 outside the nozzle 22 is ink-repellent, the surface of the nozzle plate 20 can be prevented from being wet with ink so that the straightness of ejected ink can be ensured. Thus, a coating layer formed of an ink-repellent material is formed on the surface of the nozzle plate 30 outside the nozzle 31. Perfluorinated silane is widely used as the ink-repellent material because it is known that perfluorinated silane lowers the surface energy of the nozzle plate 30 to minimize ink-wetting.

Meanwhile, an ink-repellent coating layer formed on the surface of the nozzle plate 30 should satisfy the two following requirements. First, the ink-repellent coating layer must make a large contact angle with ink. Second, after ejecting ink, the contact angle of the ink-repellent coating layer with the ink must be maintained constant in time. In other words, the ink-repellent coating layer should have high durability.

FIG. 2 is a cross-sectional view of a conventional nozzle plate used for an inkjet head, and FIG. 3 is a magnified view of region "A" shown in FIG. 2.

Referring to FIGS. 2 and 3, a nozzle plate 30 includes a silicon substrate 32 through which a nozzle 31 is formed, a thermally oxidized silicon layer 34 formed on a surface of the silicon substrate 32, and an ink-repellent coating layer 38 deposited on the thermally oxidized silicon layer 34. The ink-repellent coating layer 38 is formed of perfluorinated silane. The thermally oxidized silicon layer 34 is formed on the entire outside surface of the silicon substrate 32 including an inner wall of the nozzle 31. Also, the ink-repellent coating layer 38 is formed on the thermally oxidized silicon layer 34 formed on the silicon substrate 32 outside the nozzle 31. In the nozzle plate 30 having the above-described construction, since the adhesion of the ink-repellent coating layer 38 formed of perfluorinated silane to the thermally oxidized silicon layer 34 is weak, the performance of the ink-repellent coating layer 38 is very likely to deteriorate over time.

SUMMARY OF THE INVENTION

The present general inventive concept provides a nozzle plate for an inkjet head, which includes an ink-repellent coating layer having high durability, and a method of manufacturing the nozzle plate.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a nozzle plate for an inkjet head, including a silicon substrate having a nozzle, a thermally oxidized silicon layer formed on an outer surface of the silicon substrate and an inner wall of the nozzle, an adhesion layer deposited on the thermally oxidized silicon layer formed on the outer surface of the silicon substrate and formed of silicon oxide, and an ink-repellent coating layer deposited on the adhesion layer.

The surface of the adhesion layer on which the ink-repellent coating layer is formed may have a root mean square (RMS) roughness of about 0.5 to 2 nm. The adhesion layer may be formed using an electron-beam evaporation process.

The ink-repellent coating layer may be formed of perfluorinated silane, and a highly packed siloxane network may be formed at an interface between the adhesion layer and the ink-repellent coating layer.

The foregoing and/or other aspects and utilities of the present general inventive concept may also be achieved by providing a method of manufacturing a nozzle plate for an inkjet head, the method including preparing a silicon substrate having a nozzle, forming a thermally oxidized silicon layer on an outer surface of the silicon substrate and an inner wall of the nozzle by thermally oxidizing the silicon substrate, forming an adhesion layer of silicon oxide using an evaporation process on the thermally oxidized silicon layer formed on the outer surface of the silicon substrate, and forming an ink-repellent coating layer on the adhesion layer.

The foregoing and/or other aspects and utilities of the present general inventive concept may also be achieved by providing an inkjet head, including a nozzle plate to form a manifold, an ink chamber, and a nozzle, an ink-philic layer formed on an outer surface of the nozzle plate and an inner wall of the nozzle, an adhesion layer deposited on the ink-philic layer, and an ink-repellent coating layer deposited on the adhesion layer.

The ink-philic layer may include a thermally oxidized silicon layer.

The ink philic layer may have a first surface roughness, and the adhesion layer may have a second surface roughness higher than the first surface roughness.

The ink-philic layer may have a first surface roughness; and the adhesion layer comprises a firs-sub surface formed on the ink-philic layer and having a first-sub surface roughness corresponding to the first surface roughness, and a second sub-surface having the second surface roughness.

The adhesion layer may include a silicon oxide layer.

The ink-repellent coating layer may have a third surface roughness corresponding to the second surface roughness.

The ink-philic layer may have a first surface roughness, the adhesion layer may include a firs sub-surface formed on the ink-philic layer and having a first-sub surface roughness corresponding to the first surface roughness, and a second sub-surface having the second surface roughness, and the ink-repellent coating layer may include a third sub-surface corresponding to the second sub-surface of the adhesion layer, and a fourth sub-surface having the third surface roughness.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
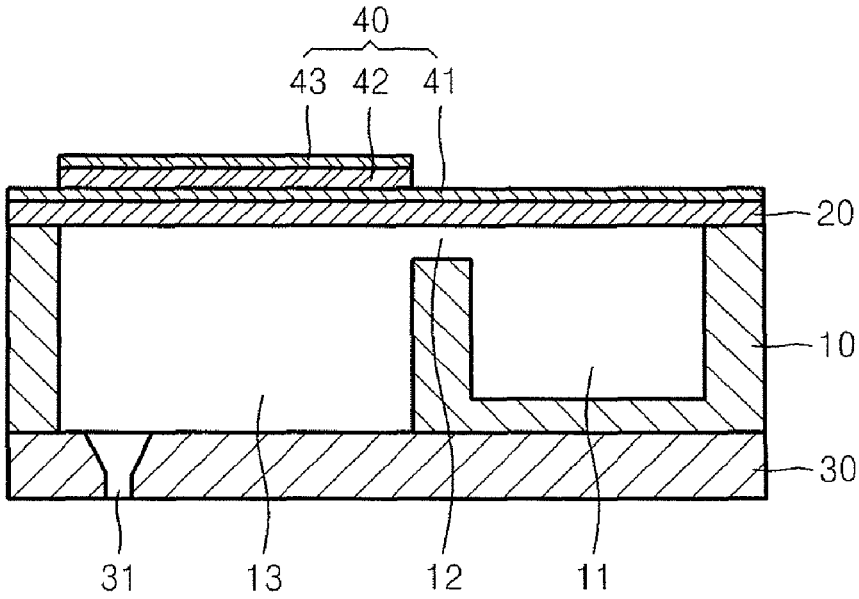
FIG. 1 (PRIOR ART)
FIG. 1 is a cross-sectional view of a conventional piezoelectric inkjet head.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
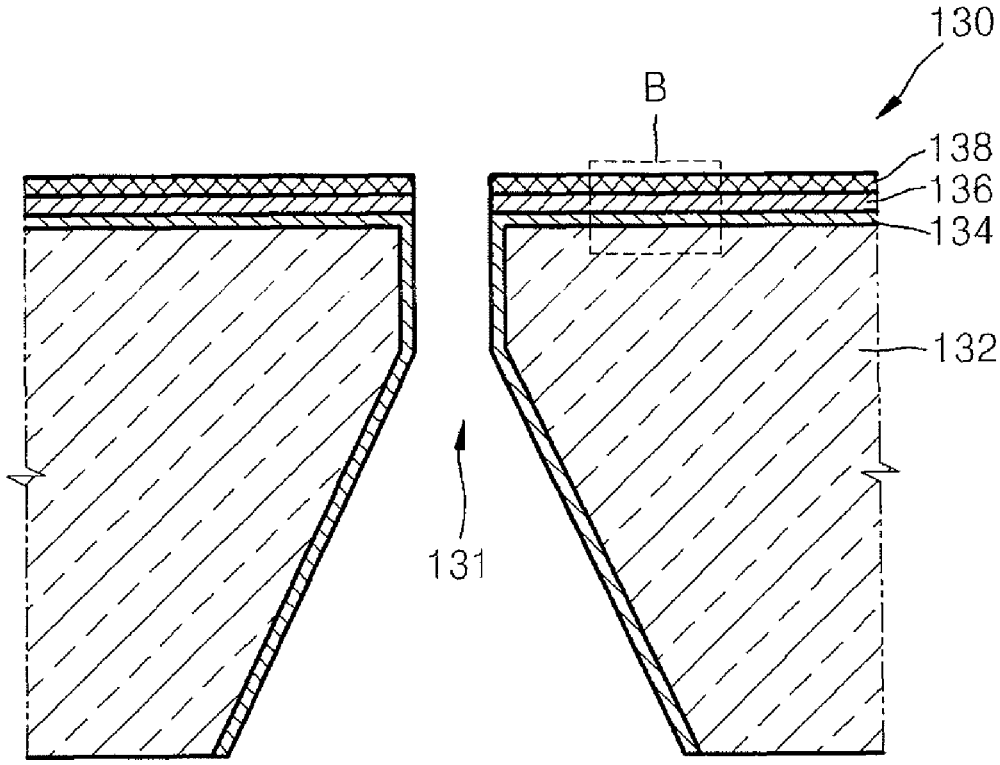
FIG. 4 is a cross-sectional view of a nozzle plate for an inkjet head, according to an embodiment of the present general inventive concept.
Figure 5:
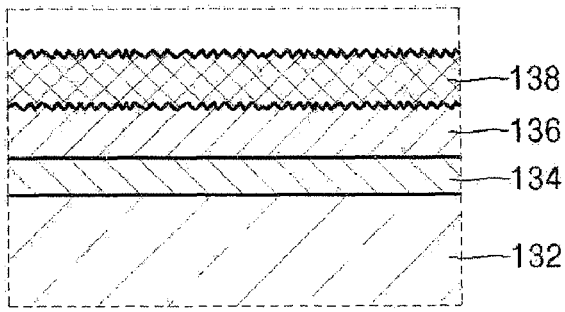
FIG. 5 is a magnified view of region "B" shown in FIG. 4.

FIG. 4 is a cross-sectional view of a nozzle plate 130 for an inkjet head according to an embodiment of the present general inventive concept, and FIG. 5 is a magnified view of region "B" shown in FIG. 4.

Referring to FIGS. 4 and 5, the nozzle plate 130 according to the embodiment of the present invention includes a silicon substrate 132, a thermally oxidized silicon layer 134 disposed on the entire surface of the silicon substrate 132, an adhesion layer 136 deposited on the thermally oxidized silicon layer 134, and an ink-repellent coating layer 138 deposited on the adhesion layer 136.

A nozzle 131 to eject ink is formed through the silicon substrate 132. The thermally oxidized silicon layer 134 is disposed on an inner wall of the nozzle 131 to form an inside wall of the nozzle 131, and also disposed on an outer surface of the silicon substrate 132. The thermally oxidized silicon layer 134 may be formed by thermally oxidizing the silicon substrate 132.

The adhesion layer 136 is disposed on the thermally oxidized silicon layer 134 located on a top surface of the silicon substrate 132, i.e., on the outer surface of the silicon substrate 132 adjacent to an outlet of the nozzle 131. For example, the adhesion layer 136 is formed to surround the nozzle area of the nozzle. The adhesion layer 136 may be formed of silicon oxide formed by an evaporation method. For example, the adhesion layer 136 formed of silicon oxide may be formed using a physical vapor deposition (PVD) process, specifically, an electron-beam (e-beam) evaporation process. When the adhesion layer 136 is formed using the e-beam evaporation process, the adhesion layer 136 may have a high surface roughness. Specifically, the surface of the adhesion layer 136 formed of silicon oxide may have a root mean square (RMS) roughness of about 0.5 to 2 nm. As described above, when the adhesion layer 136 has a high surface roughness, the adhesion of the adhesion layer 136 to the ink-repellent coating layer 138 that will be described later can be increased and a larger amount of an ink-repellent material can be deposited on the surface of the adhesion layer 136.

The ink-repellent coating layer 138 is formed on the surface of the adhesion layer 136 formed of silicon oxide. The ink-repellent coating layer 138 may be formed of perfluorinated silane. The ink-repellent coating layer 138 may be formed by depositing perfluorinated silane on the surface of the adhesion layer 136 using a PVD process, for example, an e-beam evaporation process or a thermal evaporation process. The adhesion layer 136 formed of silicon oxide has a high surface roughness as mentioned above. Thus, a larger amount of perfluorinated silane can be deposited on the surface of the adhesion layer 136 and the resulting ink-repellent coating layer 138 can have a high surface roughness like the adhesion layer 136. Therefore, the amount of perfluorinated silane as deposited becomes larger and the surface roughness of the ink-repellent coating layer 138 becomes higher so that the ink-repellent performance of the ink-repellent coating layer 138 can be greatly enhanced. Also, when the ink-repellent coating layer 138 formed of perfluorinated silane is deposited on the surface of the adhesion layer 136 with a high surface roughness, a highly packed siloxane network is formed at an interface between the adhesion layer 136 and the ink-repellent coating layer 138, so that the adhesion of the adhesion layer 136 to the ink-repellent coating layer 138 can be markedly elevated. As a result, the durability of the ink-repellent coating layer 138 can be improved.

Figure 3:
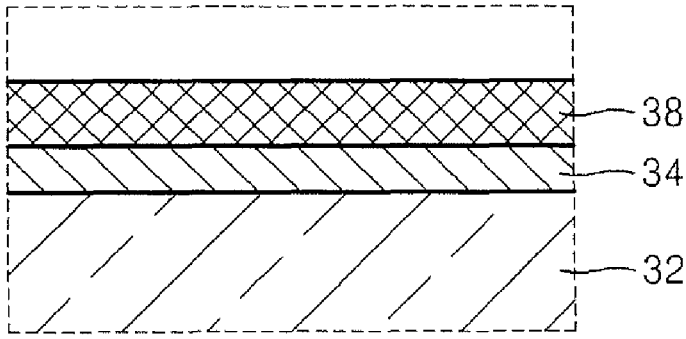
FIG. 3 (PRIOR ART)
FIG. 3 is a magnified view of region "A" shown in FIG. 2.

Hereinafter, experimental results for comparing an ink-repellent coating layer formed on the surface of a conventional nozzle plate and an ink-repellent coating layer formed on the surface of a nozzle plate according to an embodiment of the present general inventive concept will be described. The conventional nozzle plate includes an ink-repellent coating layer formed of perfluorinated silane, which is deposited on a top surface of a thermally oxidized silicon layer as illustrated in FIG. 3. The nozzle plate according to the present general inventive concept includes an adhesion layer formed of silicon oxide, which is deposited on a top surface of a thermally oxidized silicon layer, and an ink-repellent coating layer formed of perfluorinated silane, which is deposited on a top surface of the adhesion layer as illustrated in FIG. 5.

Figure 6:
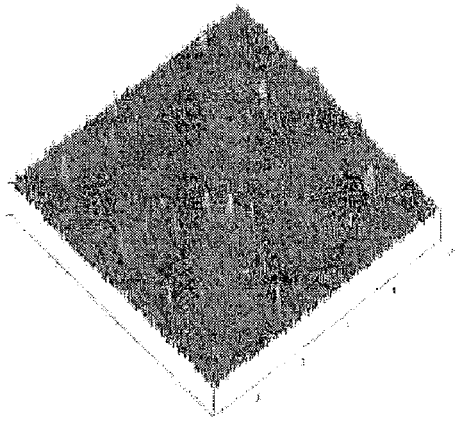
FIG. 6 is an atomic force microscope (AFM) of an ink-repellent coating layer formed on a surface of a conventional nozzle plate.
Figure 7:
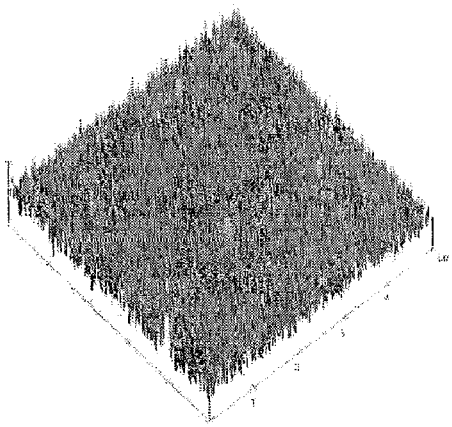
FIG. 7 is an AFM of an ink-repellent coating layer formed on a surface of a nozzle plate according to an embodiment of the present general inventive concept.

FIG. 6 is an atomic force microscope (AFM) of an ink-repellent coating layer formed on a surface of a conventional nozzle plate, and FIG. 7 is an AFM of an ink-repellent coating layer formed on the surface of a nozzle plate according to an embodiment of the present general inventive concept.

Referring to FIGS. 6 and 7, it can be observed that the ink-repellent coating layer formed on the surface of the nozzle plate according to the present invention has a higher surface roughness than that of the ink-repellent coating layer formed on the surface of the conventional nozzle plate. This is due to the fact that the adhesion layer formed of silicon oxide formed under the ink-repellent coating layer of the nozzle plate according to the present invention has a higher surface roughness than the thermally oxidized silicon layer formed under the ink-repellent coating layer of the conventional nozzle plate.

Figure 8:
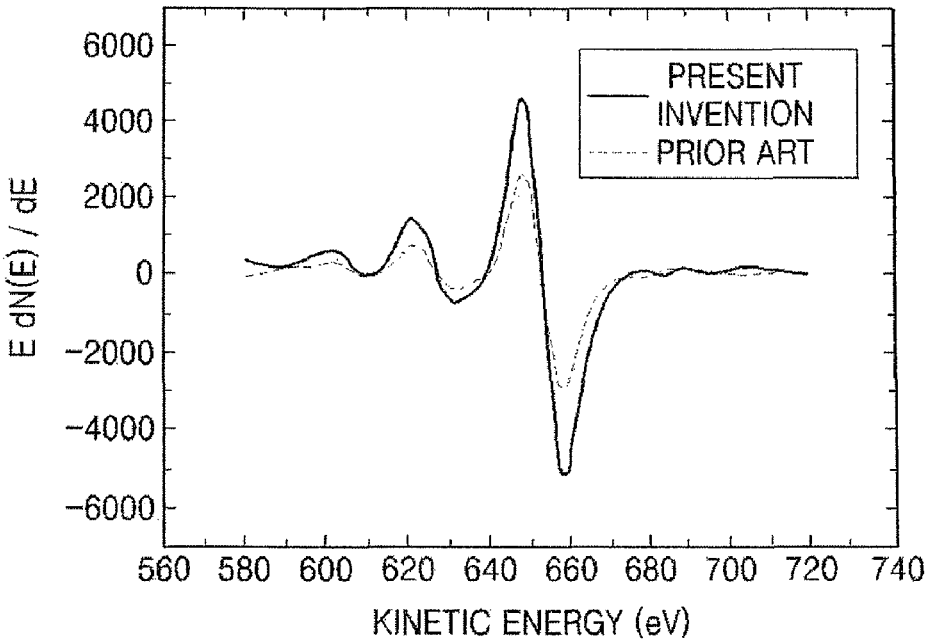
FIG. 8 shows Auger spectra obtained by the analysis of the surfaces of the ink-repellent coating layers formed of perfluorinated silane shown in FIGS. 6 and 7.

FIG. 8 shows Auger spectra obtained by the analysis of the surfaces of the ink-repellent coating layers formed of perfluorinated silane shown in FIGS. 6 and 7.

Referring to FIG. 8, it can be seen from a solid line and a dotted line according to kinetic energy (eV) and an energy (E dn(E)/dE that perfluorinated silane deposited on the surface of the nozzle plate according to the present embodiment is twice the amount of perfluorinated silane deposited on the surface of the conventional nozzle plate.

Figure 9:
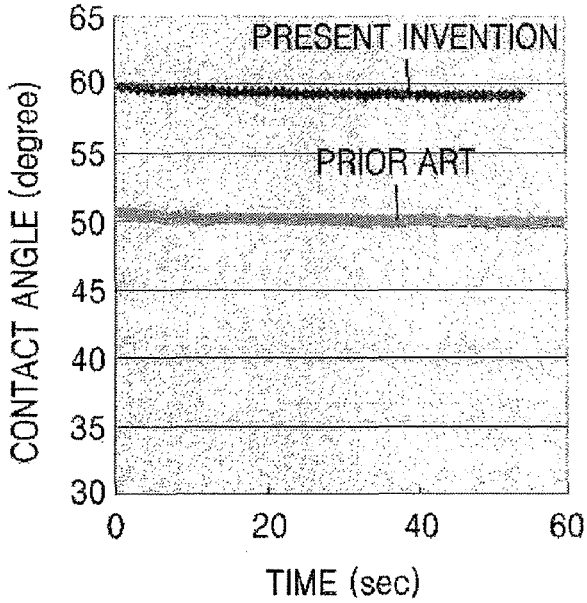
FIG. 9 is a graph showing the results of a comparison of the initial contact angles of the ink-repellent coating layers shown in FIGS. 6 and 7.

FIG. 9 is a graph showing results for comparing initial contact angles of the ink-repellent coating layers shown in FIGS. 6 and 7 with respect to a time axis.

Referring to FIG. 9, when both the initial contact angles of the ink-repellent coating layers formed on the conventional nozzle plate and the nozzle plate according to the present general inventive concept are measured using a DiPropylene glycol Methyl ether Acetate (DPMA) which is generally used as a solvent of ink, the initial contact angle of the ink-repellent coating layer formed on the conventional nozzle plate is about 50°, while the initial contact angle of the ink-repellent coating layer formed on the nozzle plate according to the present invention is about 60°. Therefore, it can be known that the present general inventive concept provides an ink-repellent coating layer with excellent performance, compared with the conventional case.

From the above-described results, it can be concluded that according to the present invention, a larger amount of perfluorinated silane is deposited on the surface of the nozzle plate and the resulting ink-repellent coating layer has a higher surface roughness than in the conventional case, thereby greatly improving the performance of the ink-repellent coating layer.

Figure 10:
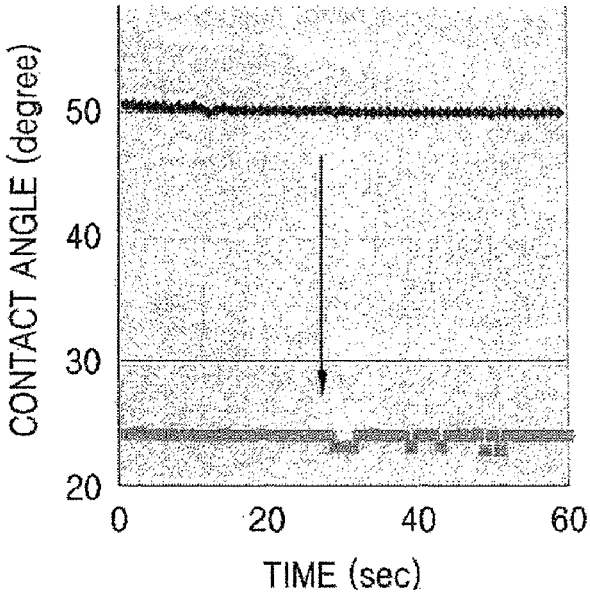
FIG. 10 is a graph showing the contact angle of the ink-repellent coating layer shown in FIG. 6 after conducting a wiping test on the ink-repellent coating layer shown in FIG. 6.
Figure 11:
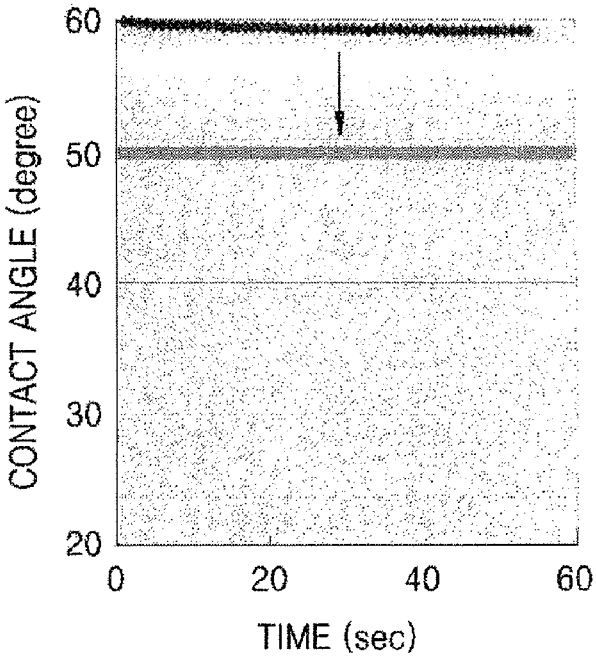
FIG. 11 is a graph showing the initial contact angle of the ink-repellent coating layer shown in FIG. 7 after conducting a wiping test on the ink-repellent coating layer shown in FIG. 7.

FIG. 10 is a graph showing the contact angle of the ink-repellent coating layer shown in FIG. 6 after conducting a wiping test on the ink-repellent coating layer shown in FIG. 6, and FIG. 11 is a graph showing the contact angle of the ink-repellent coating layer shown in FIG. 7 after conducting a wiping test on the ink-repellent coating layer shown in FIG. 7. FIGS. 10 and 11 show the result measured after performing a wiping test 500 times using a DPMA which is generally used as a solvent of ink. Referring to FIGS. 10 and 11, after the wiping test is finished, the contact angle of the ink-repellent coating layer formed on the surface of the conventional nozzle plate is reduced by about 25°, while the contact angle of the ink-repellent coating layer formed on the surface of the nozzle plate according to the present embodiment is reduced by about 10°. Based on this result, it can be concluded that the ink-repellent coating layer formed on the surface of the nozzle plate according to the present embodiment has higher durability than the ink-repellent coating layer formed on the surface of the conventional nozzle plate.

Hereinafter, a method of manufacturing a nozzle plate for an inkjet head, according to an embodiment of the present general inventive concept, will be described with reference to FIGS. 12 through 14.

Figure 12:
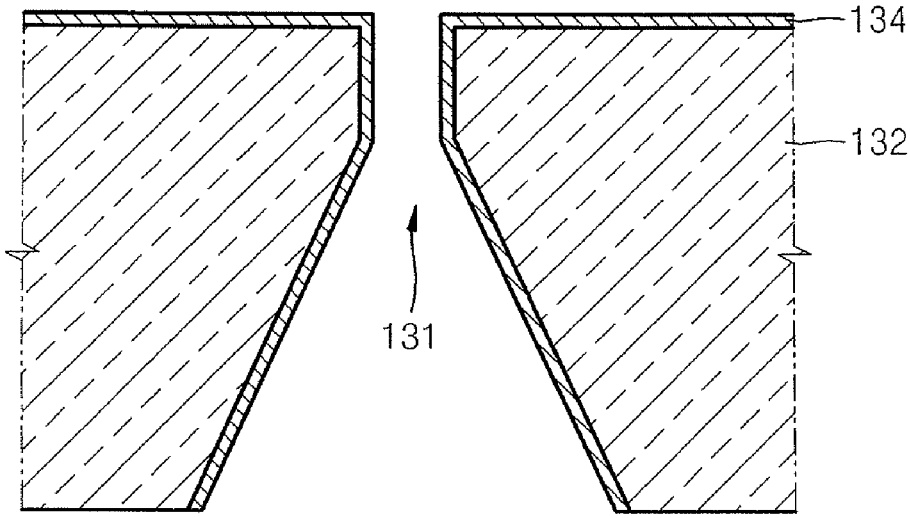
FIGS. 12 through 14 are cross-sectional views illustrating a method of manufacturing a nozzle plate according to an embodiment of the present general inventive concept.

Referring to FIG. 12, a silicon substrate 132 through which a nozzle 131 is formed is prepared. Thereafter, the silicon substrate 132 is thermally oxidized so that a thermally oxidized silicon layer 134 is formed on the entire surface of the silicon substrate 132, specifically, on an outer surface of the silicon substrate 132 and an inner wall of the nozzle 131.

Figure 13:
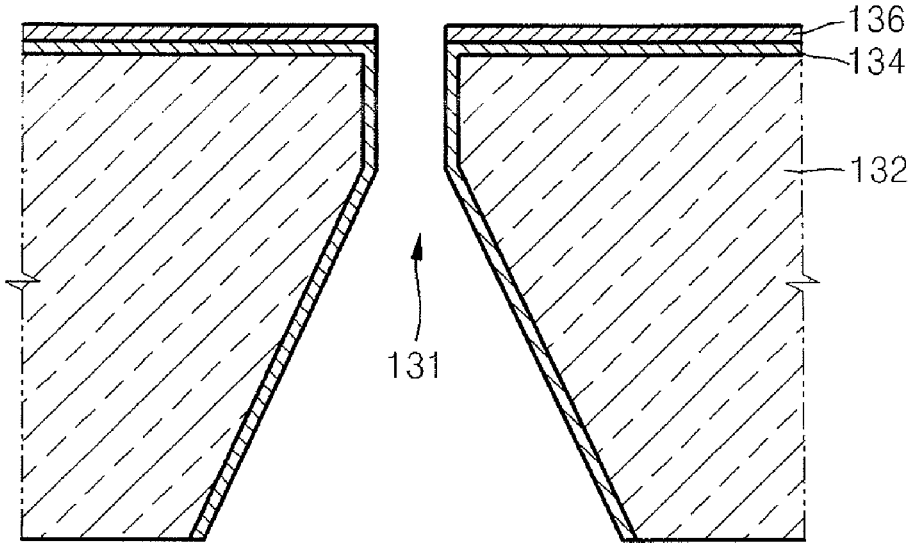

Referring to FIG. 13, an adhesion layer 136 is formed on the thermally oxidized silicon layer 134 disposed on a top surface of the silicon substrate 132, i.e., on an outer surface of the silicon substrate 132 adjacent to an outlet of the nozzle 131, for example, around the outlet of the nozzle 131. The adhesion layer 136 may be formed of silicon oxide using an evaporation method. The adhesion layer 136 may be formed of a PVD process, specifically, an e-beam evaporation process. When the adhesion layer 136 formed of silicon oxide is formed on the thermally oxidized silicon layer 134 using an evaporation method, the adhesion layer 136 can have a high surface roughness. Specifically, the surface of the adhesion layer 136 formed of silicon oxide may have an RMS roughness of about 0.5 to 2 nm.

Figure 14:
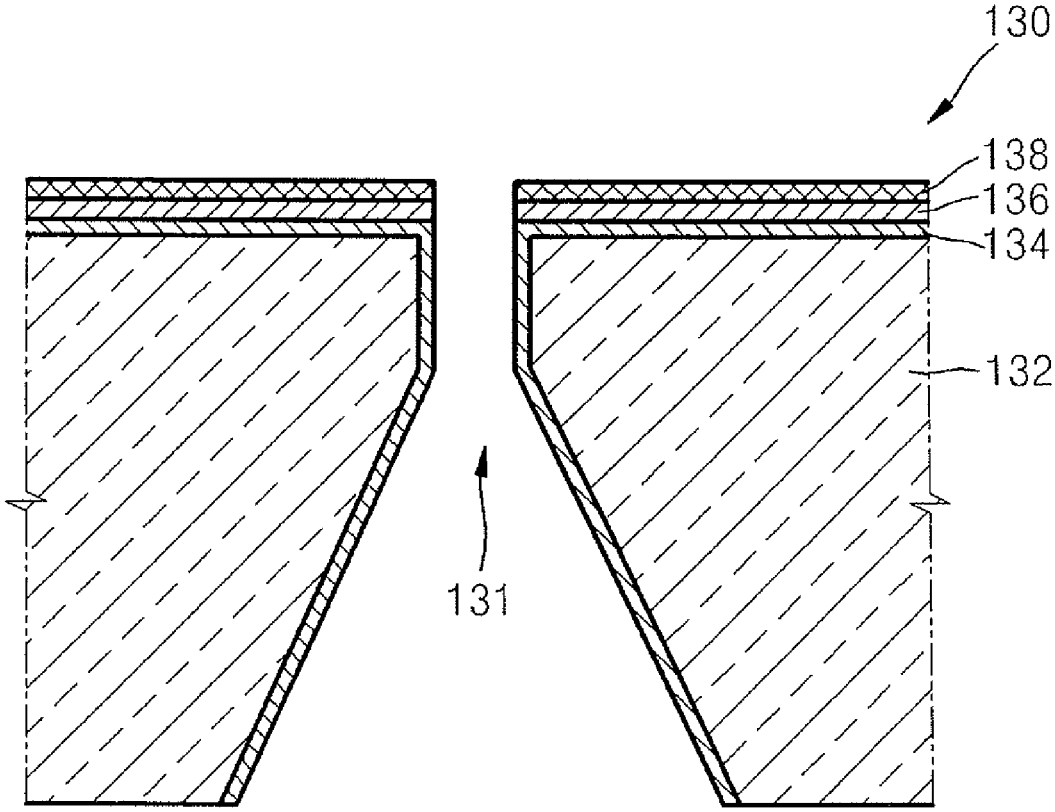

Referring to FIG. 14, an ink-repellent coating layer 138 is formed on the surface of the adhesion layer 136, thereby completing a nozzle plate 130. The ink-repellent coating layer 138 may be formed by depositing perfluorinated silane on the surface of the adhesion layer 136. The ink-repellent coating layer 138 may be formed using a PVD process, for example, an e-beam evaporation process or a thermal evaporation process. When the ink-repellent coating layer 138 formed of perfluorinated silane is formed on the surface of the adhesion layer 136 with a high surface roughness, a highly packed siloxane network may be formed at an interface between the adhesion layer 136 and the ink-repellent coating layer 138. Thus, the adhesion of the adhesion layer 136 to the ink-repellent coating layer 138 can be enhanced so that the ink-repellent coating layer 138 can have improved durability.

According to the present general inventive concept, an adhesion layer made of silicon oxide is formed using an evaporation process on a thermally oxidized silicon layer, and an ink-repellent coating layer made of perfluorinated silane is formed on the surface of the adhesion layer. Thus, the adhesion of the adhesion layer to the ink-repellent coating layer can be enhanced so that the ink-repellent coating layer can have high durability. Furthermore, since a larger amount of perfluorinated silane can be deposited on the surface of the adhesion layer than in the conventional case, the performance of the ink-repellent coating layer can be improved.

Figure 2:
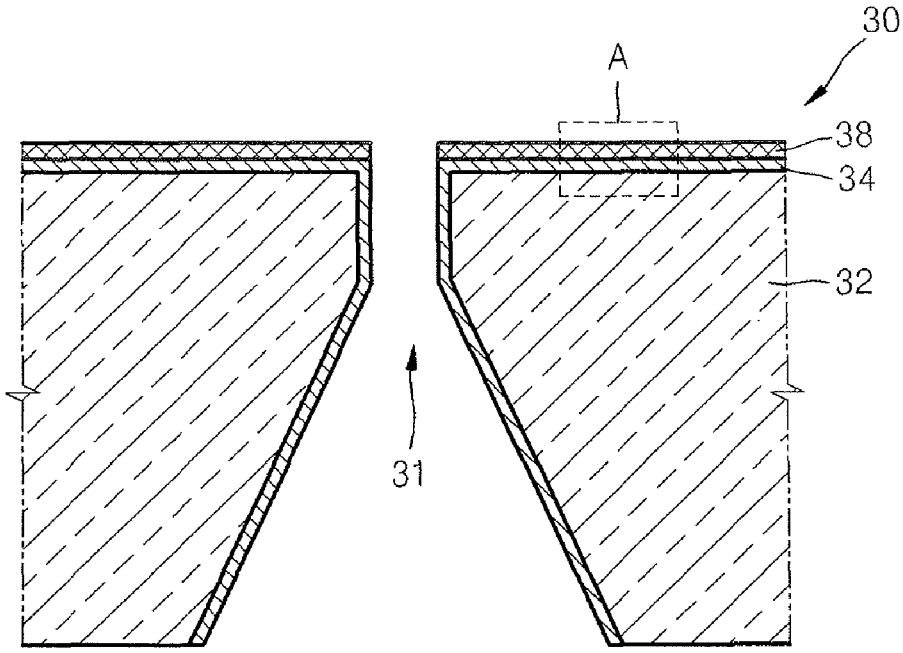
FIG. 2 (PRIOR ART)
FIG. 2 is a cross-sectional view of a conventional nozzle plate used for an inkjet head.

According to the present general inventive concept, the above-describe inkjet head may be a thermal inkjet head or a piezoelectric inkjet head. In the present embodiment, the above described adhesion layer may be formed between the thermally oxidized silicon layer 34 and the ink-repellent coating layer 38 of the conventional piezoelectric inkjet head of FIGS. 1 and 2.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A nozzle plate usable in an inkjet head, the nozzle plate comprising:

a silicon substrate having a nozzle;

a thermally oxidized silicon layer formed on an outer surface of the silicon substrate and an inner wall of the nozzle;

an adhesion layer deposited on the thermally oxidized silicon layer formed on the outer surface of the silicon substrate, and formed of silicon oxide; and an ink-repellent coating layer deposited on the adhesion layer;

wherein a densely packed siloxane network is formed at an interface between the adhesion layer and the ink-repellent coating layer.

2. The nozzle plate of claim 1, wherein a surface of the adhesion layer on which the ink-repellent coating layer is formed has a root mean square (RMS) roughness of about 0.5 to 2 nm.

3. The nozzle plate of claim 1, wherein the adhesion layer is formed using an electron-beam evaporation process.

4. The nozzle plate of claim 1, wherein the ink-repellent coating layer is formed of perfluorinated silane.

5. A method of manufacturing a nozzle plate for an inkjet head, the method comprising:

preparing a silicon substrate having a nozzle;

forming a thermally oxidized silicon layer on an outer surface of the silicon substrate and an inner wall of the nozzle by thermally oxidizing the silicon substrate;

forming an adhesion layer using an evaporation process on the thermally oxidized silicon layer formed on the outer surface of the silicon substrate, the adhesion layer formed of silicon oxide; and forming an ink-repellent coating layer on the adhesion layer;

wherein a densely packed siloxane network is formed at an interface between the adhesion layer and the ink-repellent coating layer.

6. The method of claim 5, wherein the adhesion layer is formed using a physical vapor deposition (PVD) process.

7. The method of claim 6, wherein the PVD process is an electron beam evaporation process.

8. The method of claim 5, wherein the surface of the adhesion layer on which the ink-repellent coating layer is formed has an RMS roughness of about 0.5 to 2 nm.

9. The method of claim 5, wherein the ink-repellent coating layer is formed of perfluorinated silane.

10. The method of claim 9, wherein the ink-repellent coating layer is formed using a PVD process.

11. The method of claim 10, wherein the PVD process is an electron beam evaporation process or a thermal evaporation process.

12. An inkjet head, comprising:

a nozzle plate to form a manifold, an ink chamber, and a nozzle;

an ink-philic layer formed on an outer surface of the nozzle plate and an inner wall of the nozzle;

an adhesion layer deposited on the ink-philic layer; and an ink-repellent coating layer deposited on the adhesion layer;

wherein a densely packed siloxane network is formed at an interface between the adhesion layer and the ink-repellent coating layer.

13. The inkjet head of claim 12, wherein the ink-philic layer comprises a thermally oxidized silicon layer.

14. The inkjet head of claim 12, wherein the ink phillic layer has a first surface roughness, and the adhesion layer has a second surface roughness higher than the first surface roughness.

15. The inkjet head of claim 12, wherein:

the ink-phillic layer has a first surface roughness; and the adhesion layer comprises a first sub-surface formed on the ink-philic layer and having a first sub-surface roughness corresponding to the first surface roughness, and a second sub-surface having a second surface roughness.

16. The inkjet head of claim 15, wherein: the ink-repellent coating layer comprises a third sub-surface corresponding to the second sub-surface of the adhesion layer, and a fourth sub-surface having a third surface roughness.

17. The inkjet head of claim 12, wherein the adhesion layer comprises a silicon oxide layer.

18. The inkjet head of claim 12, wherein the ink-repellent coating layer has a third surface roughness corresponding to a second surface roughness.

* * * * *